US011130137B2

(12) United States Patent
Westberg et al.

(10) Patent No.: US 11,130,137 B2
(45) **Date of Patent: *Sep. 28, 2021**

(54) DIAGNOSTIC CARTRIDGES HAVING FLEXIBLE SEALS

(71) Applicant: Nanosphere, Inc., Northbrook, IL (US)

(72) Inventors: Tom Westberg, Gurnee, IL (US); Bruce Richardson, Los Gatos, CA (US); Ryan Griswold, Los Gatos, CA (US); Chris Lewis, Los Gatos, CA (US)

(73) Assignee: NANOSPHERE, INC., Northbrook, IL (US)

( * ) Notice: Subject to any disclaimer, the term of this patent is extended or adjusted under 35 U.S.C. 154(b) by 468 days.

This patent is subject to a terminal disclaimer.

(21) Appl. No.: 16/129,094

(22) Filed: Sep. 12, 2018

(65) Prior Publication Data

US 2019/0009271 A1 Jan. 10, 2019

Related U.S. Application Data

(63) Continuation of application No. 15/819,168, filed on Nov. 21, 2017, now Pat. No. 10,092,906, which is a continuation of application No. 14/693,470, filed on Apr. 22, 2015, now Pat. No. 9,827,567.

(60) Provisional application No. 61/982,672, filed on Apr. 22, 2014.

(51) Int. Cl.
*B01L 3/00* (2006.01)

(52) U.S. Cl.
CPC ... *B01L 3/50853* (2013.01); *B01L 2200/0689* (2013.01); *B01L 2200/16* (2013.01); *B01L 2300/042* (2013.01); *B01L 2300/044* (2013.01); *B01L 2300/046* (2013.01); *B01L 2300/123* (2013.01)

(58) Field of Classification Search
CPC ..... B01L 3/50853; B01L 2200/0689; B01L 2200/16; B01L 2300/042; B01L 2300/044; B01L 2300/046; B01L 2300/123
See application file for complete search history.

(56) References Cited

U.S. PATENT DOCUMENTS

| | | | |
|---|---|---|---|
| 7,163,823 | B2 | 1/2007 | Patno et al. |
| 7,695,952 | B2 | 4/2010 | Patno et al. |
| 7,727,473 | B2 | 6/2010 | Ching et al. |
| 7,888,107 | B2 | 2/2011 | Patno et al. |
| 8,372,340 | B2 | 2/2013 | Bird et al. |
| 9,248,422 | B2 | 2/2016 | Ching et al. |
| 2003/0129094 | A1 | 7/2003 | Schubert et al. |
| 2006/0013744 | A1 | 1/2006 | Mikkelsen et al. |
| 2009/0074624 | A1 | 3/2009 | Liang |
| 2009/0191097 | A1 | 7/2009 | Hanafusa et al. |

(Continued)

OTHER PUBLICATIONS

Office Communication issued in corresponding U.S. Appl. No. 14/693,470, dated Mar. 23, 2017.

(Continued)

*Primary Examiner* — Benjamin R Whatley
(74) *Attorney, Agent, or Firm* — Parker Highlander PLLC

(57) ABSTRACT

Disclosed are cartridges and modules that may be utilized in diagnostic systems and methods. The cartridge includes a flexible seal that caps the cartridge. The flexible seal has an opening for a pipette tip, and the flexible seal is configured to create a sealed environment when a pipette tip is positioned in the opening of the flexible seal and when the pipette tip is moved in the X-axis, Y-axis, and Z-axis.

8 Claims, 10 Drawing Sheets

(56) References Cited

U.S. PATENT DOCUMENTS

| | | | |
|---|---|---|---|
| 2009/0298129 | A1 | 12/2009 | Spence et al. |
| 2013/0071946 | A1 | 3/2013 | Burghardt et al. |
| 2013/0130369 | A1 | 5/2013 | Wilson et al. |
| 2013/0288259 | A1 | 10/2013 | Tajima |
| 2013/0337432 | A1 | 12/2013 | Cook et al. |
| 2016/0216289 | A1 | 7/2016 | Augstein et al. |

OTHER PUBLICATIONS

Office Communication issued in corresponding U.S. Appl. No. 14/693,470, dated Nov. 21, 2016.

DIAGNOSTIC CARTRIDGES HAVING FLEXIBLE SEALS

CROSS-REFERENCE TO RELATED PATENT APPLICATIONS

This application is a continuation of U.S. patent application Ser. No. 15/189,168, filed on Nov. 21, 2017, which is a continuation of U.S. patent application Ser. No. 14/693,470, filed on Apr. 22, 2015, now U.S. Pat. No. 9,827,567, which claims the benefit of priority to U.S. Provisional Patent Application, Ser. No. 61/982,672, filed on Apr. 22, 2014, the content of which is incorporate herein by reference in its entirety.

BACKGROUND

The field of the invention relates to devices, methods, and systems for detecting biological molecules such as nucleic acids. In particular, the field of the invention relates to devices, methods, and systems that include or utilize diagnostic cartridges or modules.

Devices, methods, and systems that include or utilize diagnostic cartridges or modules are known in the art. (See, e.g., U.S. Pat. Nos. 7,888,107; and 7,695,952, the contents of which are incorporated herein by reference in their entireties). However, improved cartridges or modules that include a sealed environment where reagents within wells in the cartridges are transferred from one well to another well without exposing the reagents to an open environment are desirable.

SUMMARY

Disclosed are cartridges and modules that may be utilized in diagnostic systems and methods. The cartridge and modules include a flexible seal that caps and seals the cartridge or module. The flexible seal has an opening permitting insertion of a pipette tip, and the flexible seal is configured to create a sealed environment when a pipette tip is inserted in the opening of the flexible seal.

The cartridge (or module) may include multiple wells (i.e. as a multi-well cartridge). Optionally, at least one of the wells may include at least one reagent for use in a diagnostic system or method. Typically, when a pipette tip is positioned in the flexible seal, the flexible seal permits the pipette tip to enter and contact the bottom of a first well located under the seal for removing contents of the first well, and the flexible seal permits the pipette tip to move to a second well located under the seal for dispensing the contents of the first well, all while maintaining a sealed environment under the seal.

The disclosed cartridges may include a pipette tip positioned in the flexible seal. Optionally, the pipette tip may be permanently installed and fastened to the flexible seal such that it cannot be removed from the flexible seal. Preferably, the pipette tip includes a microbial filter located inside the pipette tip (e.g., a 0.2 micron microbial filter).

The disclosed cartridges may be utilized for processing a sample (e.g., a biological sample). Optionally, the cartridges may include a sample well port for introducing a sample into a sample well where the sample well is fluidly connected to a well of the cartridge located under the seal. Optionally, the cartridges may include a sample well cap inserted in the sample well port.

The wells of the disclosed cartridges are sealed by the aforementioned flexible seal. In some embodiments, the disclosed cartridges may further include a second perforable seal below the flexible seal that seals the wells of the cartridge such that the perforable seal is readily perforable via a pipette tip. Suitable materials for the second perforable seal may include aluminum film. As such, a pipette tip may be inserted in the flexible seal and through the perforable seal in order to access the contents of a well below the flexible seal and the perforable seal.

The disclosed cartridges may include one or more components that support or contain the aforementioned flexible seal. In some embodiments, the disclosed cartridges may include a middle frame that surrounds the flexible seal and provides support for the flexible seal and optionally prevents the seal from being dislocated from the cartridge. In further embodiments, the disclosed cartridges may include a top cover or a top frame that is positioned on top of the flexible seal and optionally within the middle frame.

The aforementioned flexible seal permits movement of a pipette tip positioned in the seal along an X-axis, Y-axis, and Z-axis, all while maintaining a sealed environment. Suitable flexible materials for forming the flexible seal may include elastomers, and preferably thermoplastic elastomers. Suitable thermoplastic elastomers may include styrenic block copolymers, polyolefin blends, elastomeric alloys, thermoplastic polyurethanes, thermoplastic copolyester, and thermoplastic polyamides. Suitable flexible materials for forming the flexible seal also may include silicone (i.e., polymerized siloxanes).

Also disclosed are systems that include and methods that utilize the aforementioned cartridges. For example, the aforementioned cartridges may be utilized in systems and methods for processing a sample (e.g., a biological sample). The systems and methods, a sample may be dispensed in the cartridge and processed, for example, by mixing the sample with reagents and by applying energy to the cartridge in the form of thermal heat or ultrasonic energy. The aforementioned flexible seals may be utilized to access and transfer the sample from a sample port to other wells within the aforementioned cartridges, all while maintaining a sealed environment.

DETAILED DESCRIPTION

The aforementioned devices may be described by the following definitions and figures.

Unless otherwise noted, the terms used herein are to be understood according to conventional usage by those of ordinary skill in the relevant art. In addition to the definitions of terms provided below, it is to be understood that as used in the specification, embodiments, and in the claims, "a", "an", or "the" can mean one or more, depending upon the context in which it is used. For example, "a module" should be interpreted to mean "one or more modules," depending upon the context in which it is used.

As used herein, "about", "approximately," "substantially," and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus ≤10% of the particular term and "substantially" and "significantly" will mean plus or minus >10% of the particular term, unless defined as otherwise herein.

As used herein, the terms "include" and "including" have the same meaning as the terms "comprise" and "comprising." For example, "a method that includes a step" should be interpreted to mean "a method that comprises a step." The terms "comprise" and "comprising" should be interpreted as being "open" transitional terms that permit the inclusion of additional components further to those components recited in the claims. The terms "consist" and "consisting of" should be interpreted as being "closed" transitional terms that do not permit the inclusion of additional components other than the components recited in the claims. The term "consisting essentially of" should be interpreted to be partially closed and permitting the inclusion only of additional components that do not fundamentally alter the nature of the claimed subject matter.

The presently disclosed cartridges and modules may be utilized in diagnostic systems and methods. The cartridges and modules include a flexible seal that caps and seals the cartridges or modules. The flexible seal has an opening or aperture wherein a pipette tip may be positioned. The flexible seal is configured to create a sealed environment when a pipette is positioned in the opening of the flexible seal. As such, the disclosed cartridges and modules may be utilized to prevent vaporization or spills of samples that are dispensed into the cartridges or modules. The "flexible seals" disclosed herein may otherwise be referred to as "shift boots" or "flexible bellows." The flexible seal permits movement of the pipette tip in the X-axis, Y-axis, and Z-axis (e.g., via manipulation by an XYZ robot), all while created a closed environment. The disclosed cartridges and modules typically are disposable after a single use.

Figure 1:
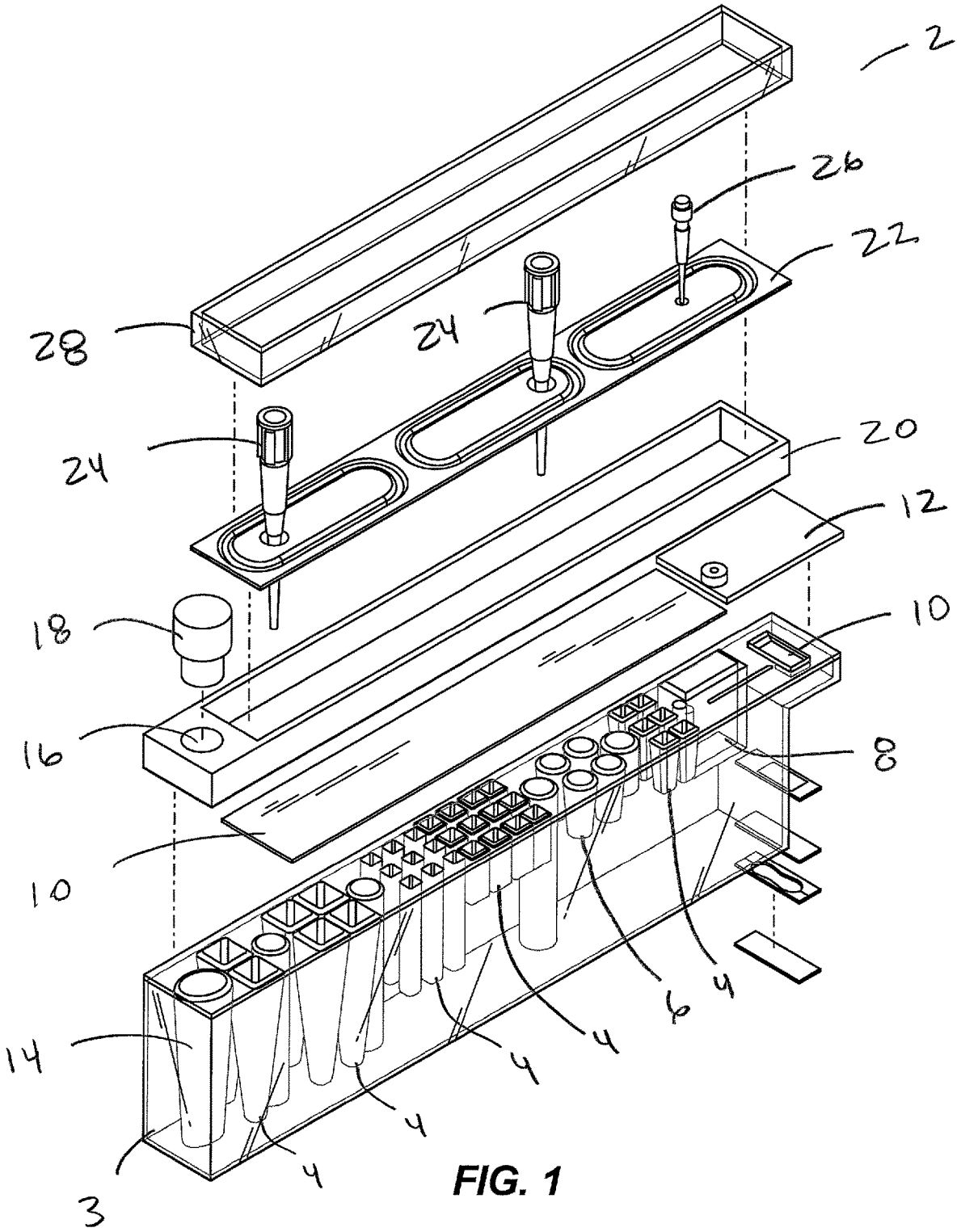
FIG. 1 provides an exploded, perspective view of one embodiment of a device as contemplated herein.

Referring now to the figures, FIG. 1 provides an exploded, perspective view of one embodiment of a device as contemplated herein. As illustrated in FIG. 1, the device is a cartridge 2 that includes a base 3 with multiple wells (or tubes) 4 that contain reagents and/or that may be used to perform combine reagents and/or to perform reactions. In particular, the cartridge includes wells (or tubes) for performing PCR (4X) 6 and a hybridization chamber 8. The cartridge 2 of FIG. 1 also includes a perforable foil seal 10 for sealing the tops of the wells (or tubes) 4 and a hybridization chamber cover 12 for covering the hybridization chamber 8 and an analysis chamber 10. The cartridge 2 also includes a sample well 14 for containing a sample, a sample well port 16 for introducing a sample, and a sample well cap 18 for covering the sample well port 16 and closing the sample well 14 to the environment. The cartridge of FIG. 1 also includes a middle frame 20 that sits on top of the foil seal 10 and the sample port 16 is located within the middle frame 16. The cartridge 2 also includes a flexible seal/shift boot 22 placed within the middle frame 20. As illustrated, the flexible seal or shift boot 2 includes two (2×) large pipette tips 24 and one small pipette tip 26 but may include any number of large pipette tips and/or small pipette tips. A top cover/frame 28 is placed on top of the flex seal/shift boot.

Figure 2:
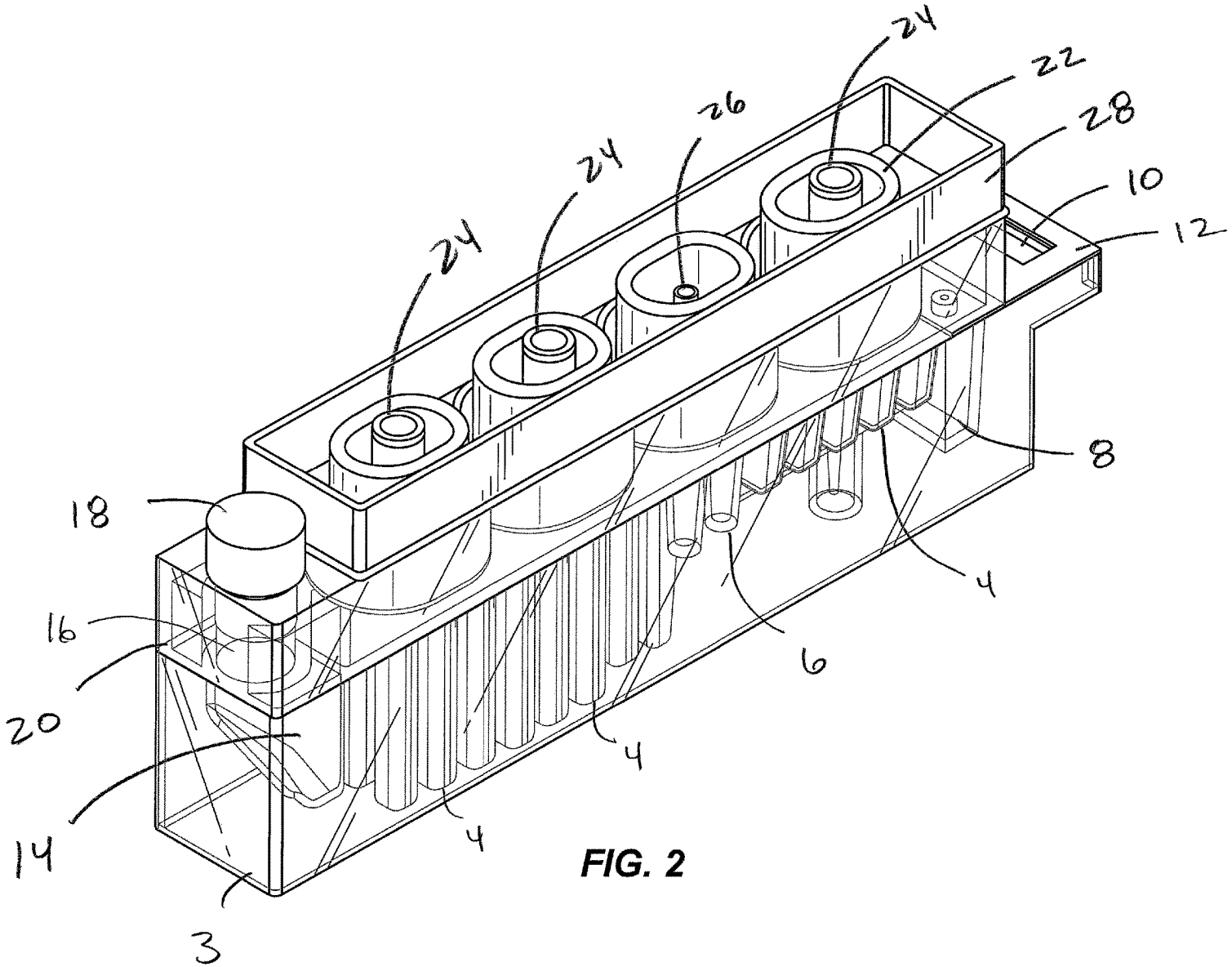
FIG. 2 provides an assembled, perspective view of one embodiment of a device as contemplated herein.

FIG. 2 provides an assembled, perspective view of one embodiment of a cartridge 2 as contemplated herein and similar to the cartridge of FIG. 1. As illustrated, the flex seal/shift 22 boot of the cartridge 2 of FIG. 2 includes two (3×) large pipette tips 24 and one small pipette tip 26.

Figure 3:
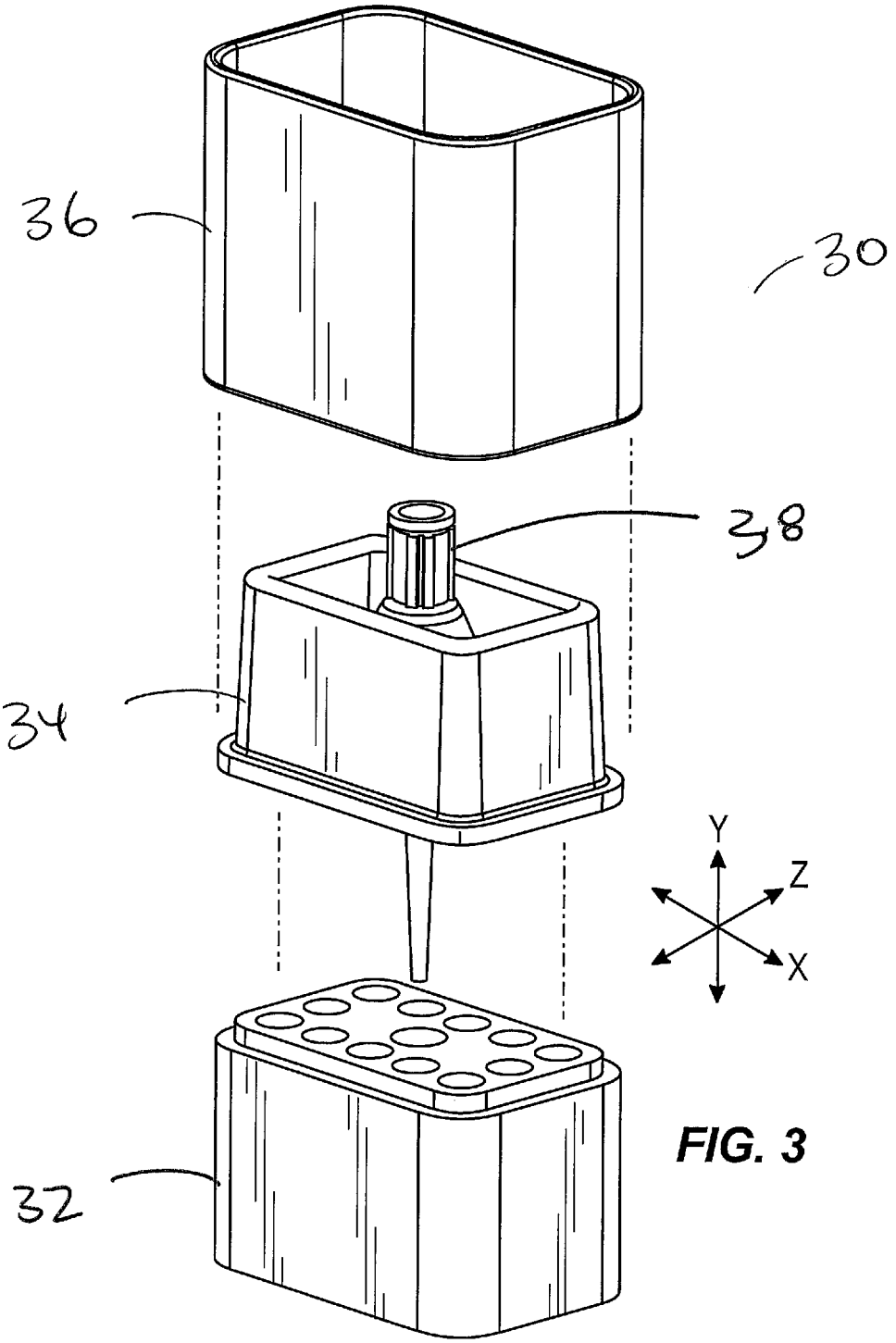
FIG. 3 provides an exploded, perspective view of one embodiment of a device as contemplated herein.

FIG. 3 provides an exploded, perspective view of one embodiment of a device as contemplated herein. As illustrated in FIG. 3, the device is a module 30 that includes a multi-well chamber 32 a flexible seal 34, and a frame 36 surrounding the flexible seal 34. A pipette tip 38 is positioned in the flexible seal 34 such that the multi-well chamber 32 under the flexible seal 34 is closed to the environment. The flexible seal 34 permits movement of the pipette tip 38 in the X-axis, Y-axis, and Z-axis such that the pipette tip 38 can contact and transfer the contents of the wells of the multi-well chamber (e.g., to an adjacent well), all while maintain a sealed environment under the flexible seal 34.

Figure 4:
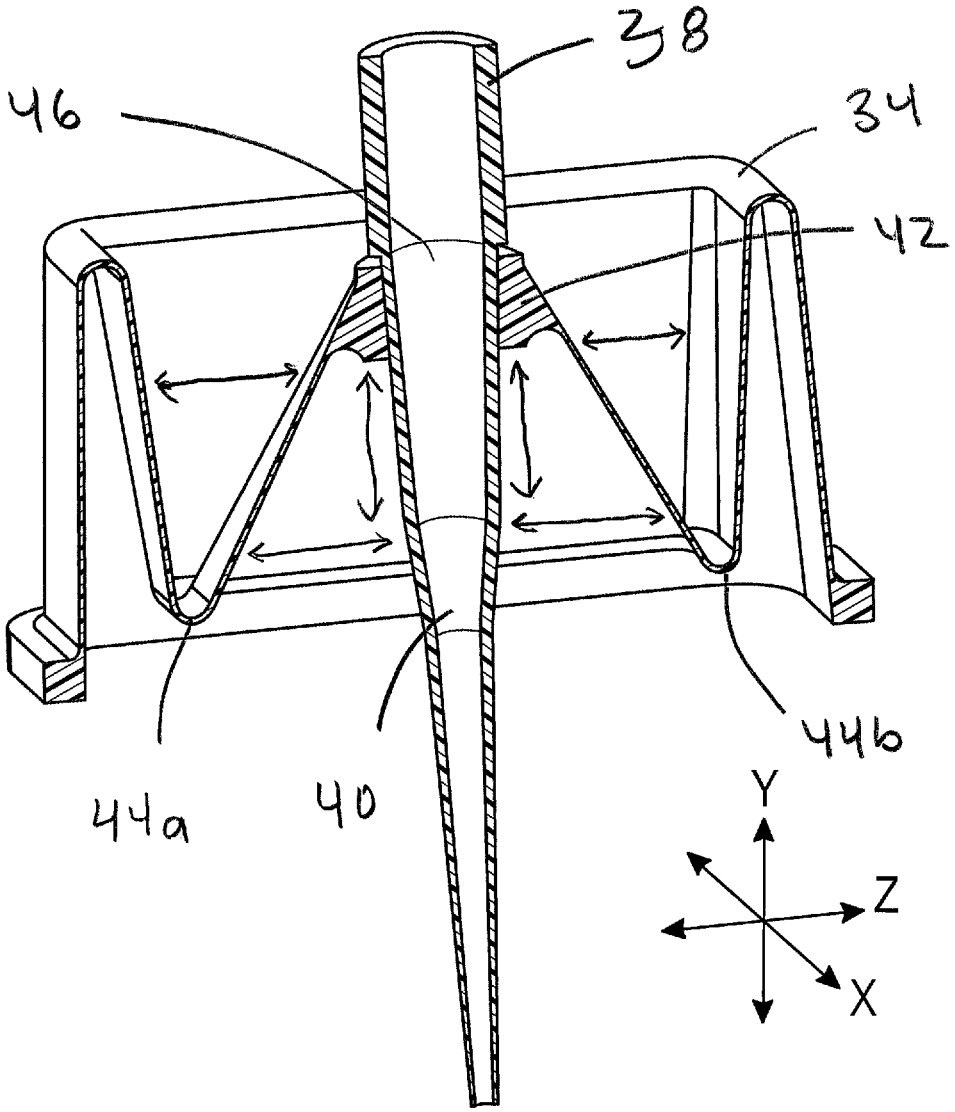
FIG. 4 provides a cross-sectional, perspective view of one embodiment of a pipette tip positioned in a flexible seal as contemplated herein.

FIG. 4 provides a cross-sectional, perspective view of the pipette tip 38 as positioned in the flexible seal 34 of FIG. 3. As illustrated in FIG. 4, the pipette tip 38 includes a microbial filter 40. As illustrated in the cross-sectional, perspective view of FIG. 4, the flexible seal 34 is configured to include a peak 42 located between two valleys 44*a*, 44*b*. The peak 42 includes an opening 46 for inserting the pipette tip 38. The configuration of the flexible seal 34 permits movement of the pipette tip 38 in the X-axis, Y-axis, and Z-axis (see illustrative directional arrows), all while maintaining a sealed environment under the flexible seal 34. For example, the configuration of the flexible seal 34 permits movement of the pipette tip 38 in the X-axis and Z-axis directions via expansion and/or compression of the respective valleys 44*a*, 44*b* in the corresponding X-axis or Z-axis direction. As illustrated in FIG. 4, the pipette tip may be moved in the Z-axis direction via expansion of the valley 44*a* and via compression of the valley 44*b*. The configuration of the flexible seal 34 also permits movement of the pipette tip 38 in the Y-axis direction via expansion and/or compression of the peak 42 in the corresponding Y-axis direction.

Figure 5:
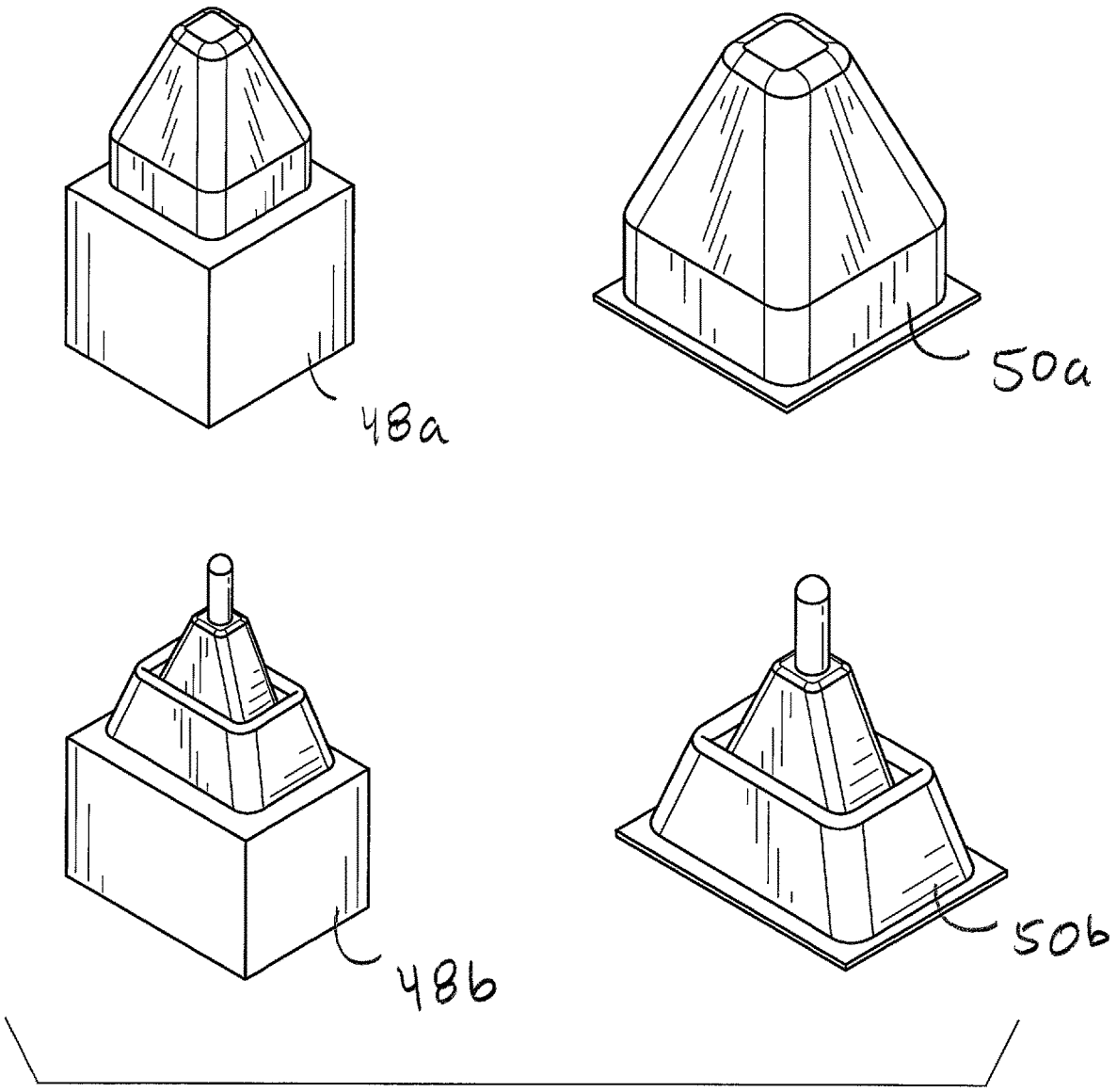
FIG. 5 illustrates perspective views of molds and boots (i.e., flexible seals) that may be formed using the illustrated molds.

FIG. 5 illustrates perspective views of molds 48*a*, 48*b* as well as boots (i.e., flexible seals) 50*a*, 50*b* that may be formed using the illustrated molds.

Figure 6:
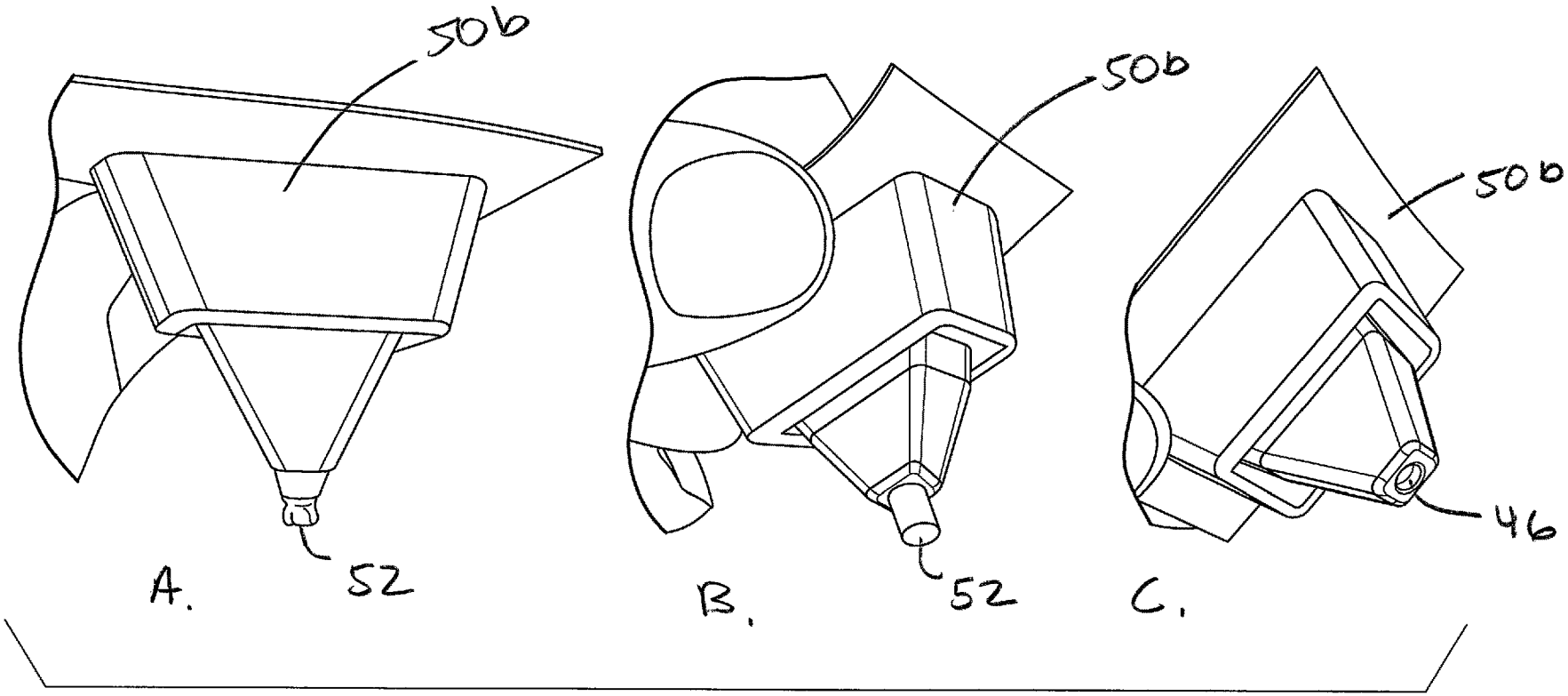
FIG. 6 illustrates a method of making a flexible seal as contemplated herein.

FIGS. 6A, B, and C illustrate a method of making a boot or flexible seal 50*b* of FIG. 5 using the mold 48*b* of FIG. 5. A. Mold 48*b* is utilized to form a boot or flexible seal 50*b*. B. The boot or flexible seal 50*b* is removed from the mold 48*b*. C. The material 52 at the tip of the flexible seal 50*b* is removed (e.g. snipped off) creating an opening or aperture 46 in the flexible seal 50*b* in which a pipette tip may be inserted or positioned.

Figure 7:
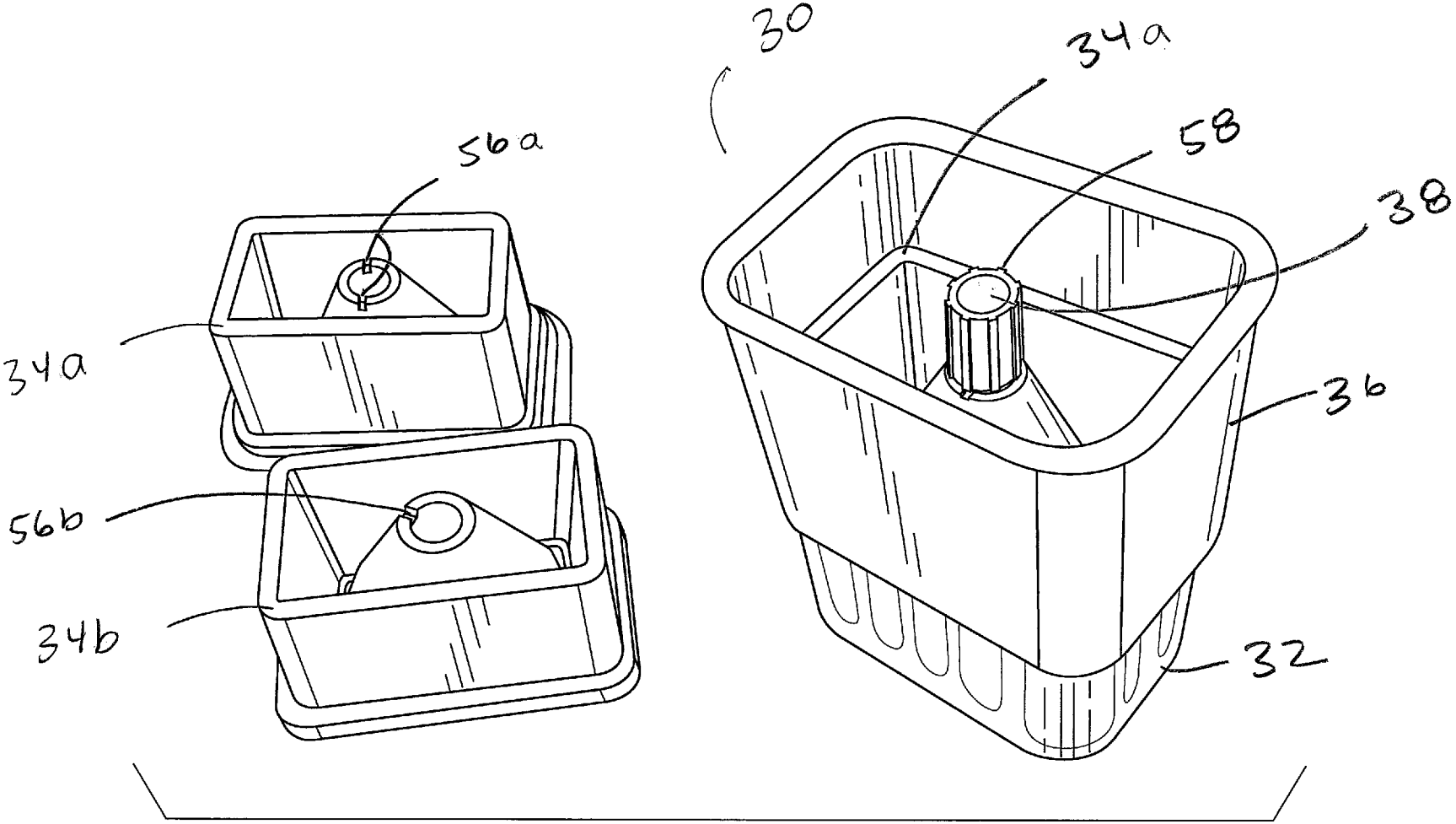
FIG. 7 illustrates additional embodiments of modules comprising a flexible seal as contemplated herein.

FIG. 7 provides additional embodiments of flexible seals 34*a*, 34*b*, and a module 30 comprising a flexible seal 34*b* as contemplated herein. As illustrated in FIG. 7, the flexible seals 34*a*, 34*b* include one or more grooves 56*a*, 56*b* for positioning a pipette tip 38 in the flexible seal via one or more corresponding ridges 58 on the pipette tip 38.

Figure 8:
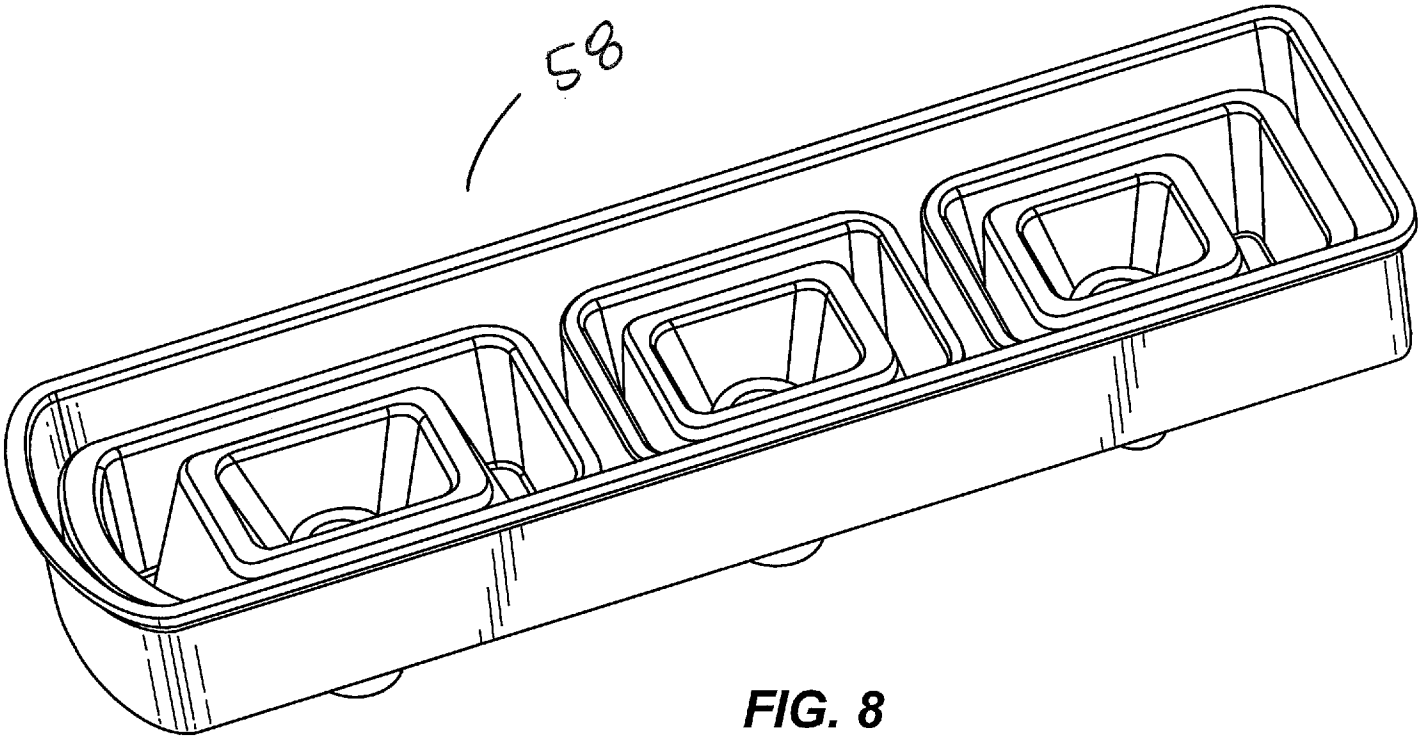
FIG. 8 provides a perspective view of one embodiment of a boot/flexible seal as contemplated herein.
Figure 9:
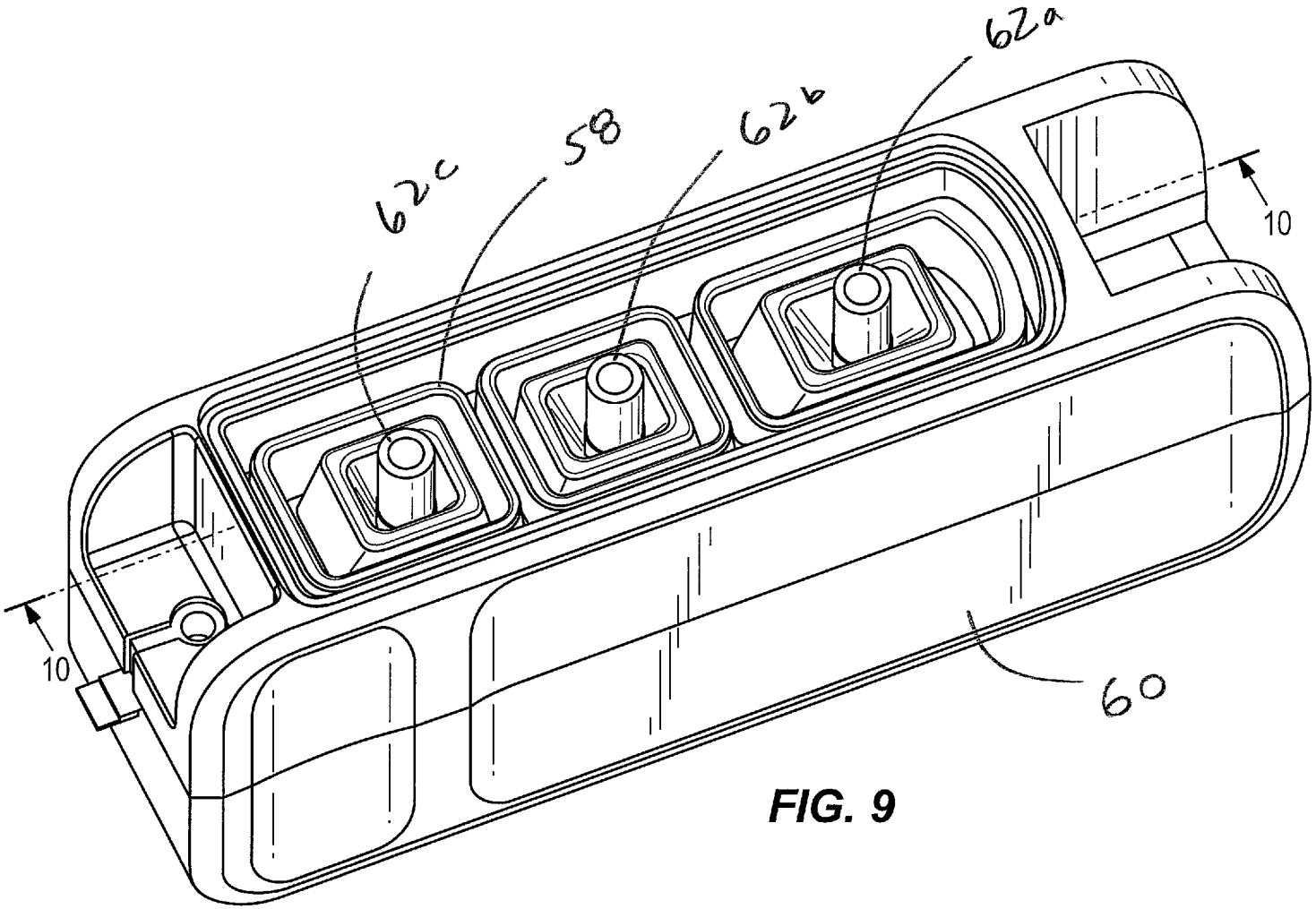
FIG. 9 provides a perspective view of one embodiments of a cartridge comprising the boot/flexible seal of FIG. 8.

FIG. 8 illustrates another embodiment of a boot/flexible seal 58 as contemplated herein. FIG. 9 illustrates the boot or flexible seal 58 of FIG. 8 as positioned in a cartridge 60 with pipette tips 62*a*, 62*b*, 62*c* positioned in the boot/flexible seal 58.

Figure 10:
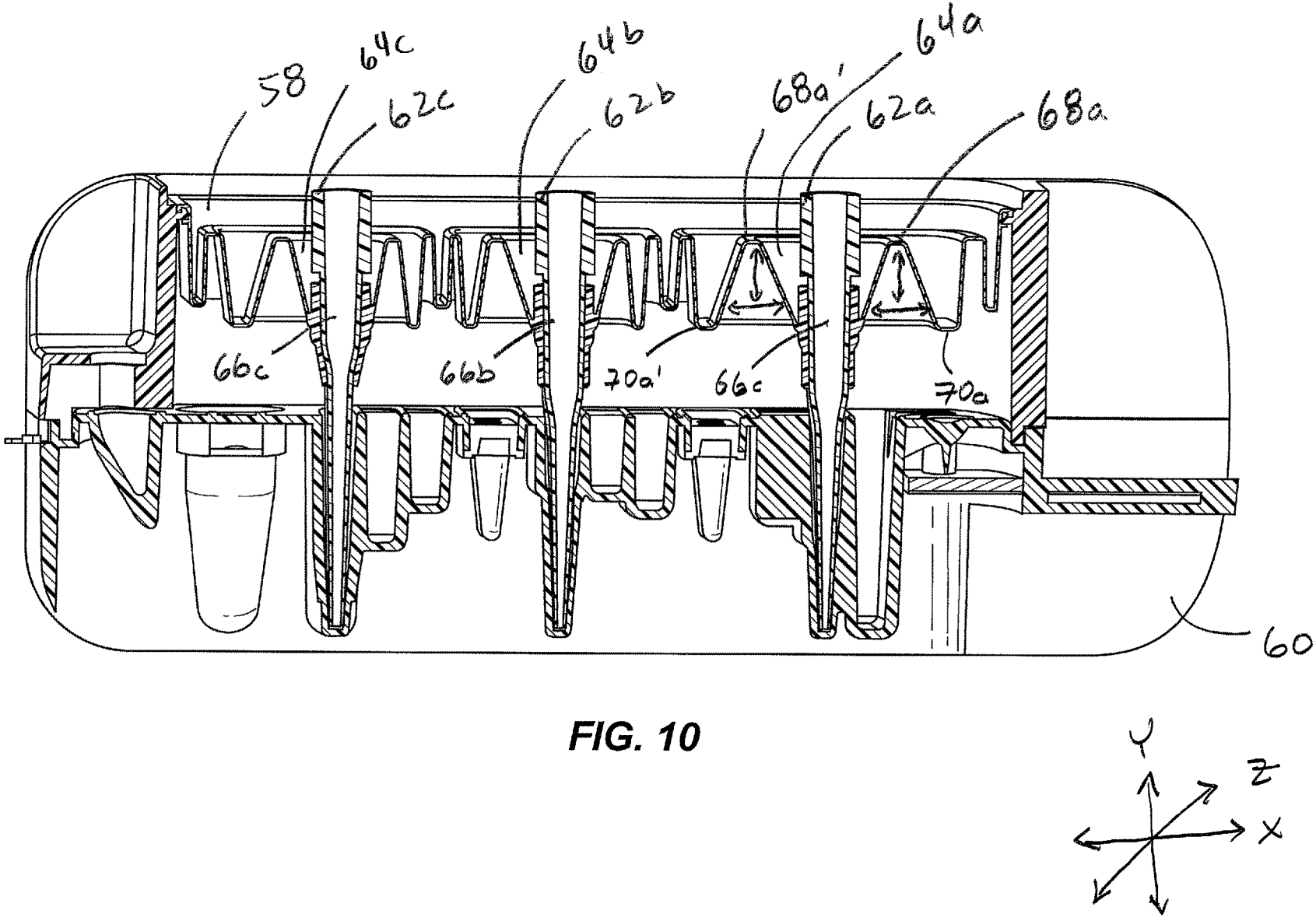
FIG. 10 provides a cross-section view of the cartridge of FIG. 9 comprising the boot/flexible seal of FIG. 8.

FIG. 10 provides a cross-sectional view of the cartridge 60 of FIG. 9. As illustrated in the cross-sectional view of FIG. 10, the boot/flexible seal 58 is configured to include interior valleys 64*a*, 64*b*, 64*c*, having openings 66*a*, 66*b*, 66*c*, into which the pipette tips 62 are inserted. Also as illustrated in the cross-sectional view of FIG. 10, adjacent to the interior valleys are peaks (e.g. 68*a*, 68*a*') and exterior valleys (e.g., 70*a*, 70*a*'). The configuration of the boot/flexible seal 58 thusly permits movement of the pipette tip 38 in the X-axis, Y-axis, and Z-axis via compression/expansion of the respective valleys and/or peak (see illustrative directional arrows), all while maintaining a sealed environment under the flexible seal 34.

In the foregoing description, it will be readily apparent to one skilled in the art that varying substitutions and modifications may be made to the invention disclosed herein without departing from the scope and spirit of the invention. The invention illustratively described herein suitably may be practiced in the absence of any element or elements, limitation or limitations which is not specifically disclosed herein. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention. Thus, it should be understood that although the present invention has been illustrated by specific embodiments and optional features, modification and/or variation of the concepts herein disclosed may be resorted to by those skilled in the art, and that such modifications and variations are considered to be within the scope of this invention.

What is claimed is:

1. A cartridge for processing a sample, the cartridge comprising:

(a) a base;

(b) a plurality of wells disposed in the base;

(c) a frame located on top of the base;

(d) a flexible seal disposed in the frame and having plurality of openings; and (e) a pipette tip comprising a microbial filter positioned in each of the plurality of openings of the flexible seal, wherein the flexible seal permits the movement of the pipette tips in an X-axis, a Y-axis, and a Z-axis;

wherein the base, the frame, the flexible seal, and the pipette tips define a space encompassing the plurality of wells that is a sealed environment.

2. The cartridge of claim 1, wherein:

the plurality of wells comprises a sample well;

the cartridge further comprises:

a sample well port fluidly connected to the sample well; and a sample well cap removably covering the sample well port, wherein the flexible seal does not cover or seal the sample well port.

3. The cartridge of claim 1, wherein the flexible seal comprises a thermoplastic elastomer.

4. The cartridge of claim 3, wherein the thermoplastic elastomer is selected from the group consisting of styrenic block copolymers, polyolefin blends, elastomeric alloys, thermoplastic polyurethanes, thermoplastic copolyester, and thermoplastic polyamides.

5. The cartridge of claim 1, wherein the flexible seal comprises silicone.

6. The cartridge of claim 1, wherein the flexible seal comprises at least three openings and at least three pipette tips disposed in the at least three openings.

7. The cartridge of claim 1, further comprising a perforable seal disposed between the flexible seal and the base, wherein the perforable seal is perforable via the pipette tip.

8. The cartridge of claim 7, wherein the perforable seal is a foil seal.

* * * * *